United States Patent [19]

Bell

[11] Patent Number: 4,718,738

[45] Date of Patent: Jan. 12, 1988

[54] FLEXIBLE BANK FOR COINS

[75] Inventor: Gary M. Bell, Crystal, Minn.

[73] Assignee: Kapak Corp., St. Louis Park, Minn.

[21] Appl. No.: 931,530

[22] Filed: Nov. 14, 1986

[51] Int. Cl.[4] ..... F16C 32/06

[52] U.S. Cl. ..... 383/121; 383/907; 383/104; 383/107; 229/8.5; D99/35; 206/0.8

[58] Field of Search ..... 383/121, 907, 106, 104, 383/66, 107; 206/0.8, 462, 463; D99/35; 446/8; 229/8.5

[56] References Cited

U.S. PATENT DOCUMENTS

| | | | |
|---|---|---|---|
| 1,239,143 | 9/1917 | Van Horn | 229/8.5 |
| 1,456,133 | 5/1923 | Knight | 229/8.5 |
| 3,438,567 | 4/1969 | Bell, Jr. | 383/104 |
| 3,640,381 | 2/1972 | Kanada et al. | 383/104 |
| 3,799,914 | 3/1974 | Schmit et al. | 383/104 |

*Primary Examiner*—Willis Little

*Attorney, Agent, or Firm*—Merchant, Gould, Smith, Edell, Welter & Schmidt

[57] ABSTRACT

A flexible bag operable as a coin bank includes first and second sidewall members and a base portion. The sidewall members and base portion may be constructed from a flexible plastic material, such as a polyethylene plastic, which is capable of being heat-sealed. The flexible bag includes the plurality of edges, all of which are sealed to define an internal coin receiving chamber. Access to the chamber is provided by means of a coin slot, enabling coins to readily be placed into the bag, one at a time. Preferably the coin slot is sized to generally inhibit removal of large numbers of coins from the bag, without substantial difficulty. The flexible bag includes retaining means serving to keep the coin slot held substantially open for facilitating deposit of coins therein, at preferred times. The flexible bag bank may be constructed from materials sufficiently inexpensive and easy to cut open to facilitate complete destruction of the bank, when access to the coins is desired.

5 Claims, 7 Drawing Figures

FLEXIBLE BANK FOR COINS

BACKGROUND OF THE INVENTION

The present invention relates to coin banks and in particular to a flexible bank for use in saving and storing coins. The particular bank of the preferred embodiment is such as to be disposible following use.

Numerous types of conventional banks are well known. Many of such banks have fairly rigid, hollow, structures; the banks having been formed from metals, ceramics, wood or the like. Such banks generally include a coin slot in an upper portion thereof, and have an access aperture in the lower portion thereof; the access aperture being retained closed by a plug. A user storing coins in such a bank generally inserts them through the coin slot, with the coins being retained within the bank by the plug member in the access aperture. When the bank is full, or otherwise when it is desired that the coins be removed from such a bank, the aperture plug is removed from the access aperture, and the bank is shaken or otherwise manipulated to remove the coins therefrom. For some conventional coin banks, particularly those of the ceramic type, an access aperture may be missing; with the bank being broken open at a time when it is desired that the coins be removed therefrom.

While such conventional banks have had wide popularity, they are not generally acceptable for situations in which it is desired that coins be conveniently stored in a non-decorative, disposable, container which, when filled with coins, may be taken to, and left at, a bank or other institution whereat the coins may be dumped from the container for counting and sorting.

In some instances in which coins are temporarily stored, for example during an accumulation before transfer to a savings institution or the like, bags such as heavy fabric bags are used. Such bags, while they avoid many of the problems of conventional rigid-structured banks, also suffer from numerous limitations. For example, such bags can be relatively expensive to manufacture, clean and maintain. Further, such bags may wear out and rupture under repeated use, in some instances leading to unexpected, uncontrolled and undesired spillage of coins. While this latter problem might be avoided by limiting repeated use, it is a drawback to such bags because they may be too expensive to use only a few times. Further, they may be too expensive for the typical consumer to fill and leave at a savings institution for disposal.

Another drawback to the utilization of a simple, conventional, fabric bag to hold coins is that should the bag tip over, the coins may fall outwardly from an upper portion thereof. Even if the upper portion of the bag includes an enclosure means such as string ties, a zipper or the like, to retain same shut, the bag may still be undesirable as a savings bank. A reason for this is that the zipper or other enclosure means permits ready access to the interior of the bank, so that coins may be readily removed therefrom, without leaving notice, before the bag is transferred to the savings institution or wherever. Thus, coins might be stolen from the container without leaving a trace. Further, such closure means add cost to the product.

What has been needed is a relatively inexpensive, disposible, bank or receptacle for the storage of coins, that is relatively inexpensive to produce, relatively strong, and of a design enabling coins to be readily stored therein. Preferably such a bank would have a design making it relatively difficult to rapidly remove coins therefrom, without the leaving of some type of permanent mark or other indication on the bank to indicate tampering. Further, a preferred feature of such a bank is that when opening for complete removal of coins therefrom is desired, same may be relatively easily accomplished. Other preferred features of such a bank, to overcome problems in conventional systems including those described above, are that the bank should be of a design enabling easy storage and also that it should be relatively easy to insert coins into the bank, when desired.

OBJECTS OF THE INVENTION

Therefore, the objects of the present invention are: to provide a coin bank comprising a generally sealed flexible bag having a sidewall with a coin slot therein; to provide such a bag having retaining means therein facilitating maintenance of the coin slot in a substantially open and coin-receiving orientation; to provide such a bag formed from first and second sidewall members and a base portion cooperatively engaging one another to define an internal coin receiving chamber; to provide such a bag wherein the first and second sidewall members, and the base portion, may be formed from a plastic material capable of being heat-sealed; to provide such a bag which is substantially flat when empty; to provide such a bag which may be easily opened when desired; to provide such a bag wherein the first and second sidewall members define an upper edge of the bag that is closed by means of a heat-seal extending therealong; to provide such a bag wherein the coin slot is positioned substantially adjacent to, and spaced apart from, an upper heat-seal in an upper portion of the bag; to provide such a bag wherein the coin slot has an upper lip member and a lower lip member maintained laterally spaced apart from one another, in part by means of the heat-seal, to retain the coin slot in a substantially open orientation, for relatively easy receipt of coins during use of the bank; and, to provide such a bank which is relatively inexpensive to produce, which is relatively easy to manufacture, which is simple to use, and which is particularly well adapted for the proposed uses described.

Other objects and advantages of this invention will become apparent from the following descriptions taken in connection with the accompanying drawings, wherein are set forth by way of illustration and example certain embodiments of this invention.

SUMMARY OF THE INVENTION

A coin bank is provided for facilitating storage and transfer of coins. The bank comprises a flexible bag or bag means defining an internal coin-receiving chamber, wherein coins may be selectively stored. The bag of the preferred embodiment is disposible, following a single use.

The bag of the preferred embodiment has a substantially flat, envelope-like, structure when empty, facilitating storage. The bag has a flexible sidewall structure, and thus expands as filled with coins. A coin slot is positioned in the sidewall structure of the bag, to enable access to the internal coin-receiving chamber, for passage of coins into the bag. Preferably, the coin slot is sufficiently large to enable coins to be dropped, generally one at a time, into the bag, but is also sufficiently small to generally inhibit easy removal of coins from the bag, as for example when the bag is tipped over.

The flexible bag of the preferred embodiment is generally constructed from a plastic material capable of being heat-sealed. The preferred flexible bag has a three-piece structure comprising first and second sidewall members, and a base portion or member. For the preferred embodiment the sidewall members are generally rectangular and are substantially mirror images of one another, but for the presence of the coin slot in one side. Each sidewall member has: an upper, generally horizontal, edge; equal, opposite and generally parallel side edges; and, a bottom portion. The first and second sidewall members are generally heat-sealed to one another along the upper edges to form an upper heat-seal, and also are heat-sealed along the side edges.

For the preferred embodiment, the base portion of the flexible bag is attached to the sidewall members by means of heat-sealing, to form an enclosed bottom in the bank. As will be understood from the detailed description, the preferred bottom portion includes a laterally extending fold therein, so that the bag may be folded relatively flat during storage. As the bank is filled with coins, however, the bottom portion will unfold, allowing expansion of the bag and providing a base permitting the bag or bank to stand somewhat upright.

One of the sidewall members includes the coin slot therein, enabling coins to be poured into the internal or coin-receiving chamber of the bank. In the preferred embodiment the coin-receiving slot is oriented substantially adjacent, but spaced apart from, the upper sealed edge of the flexible bag. The reason for this is that the coin slot generally includes an upper lip member and a lower lip member, which should be spread laterally apart to permit coins to be readily inserted into the bank when the coins are dropped substantially vertically. If the coin slot is positioned substantially adjacent, but spaced apart from, the upper seal, the upper seal will tend to act as a retaining means, retaining the upper lip member of the coin slot laterally spaced apart from the lower lip member. In this manner, the slot will gape open when the bag stands upright, permitting a coin to be easily dropped into the internal chamber. As will be seen from the detailed description, this feature becomes particularly important as the bag or bank increasingly fills with coins. Also, the gap will tend to close, should the bag tip over, reducing loss of coins through the slot.

In the detailed description certain specific dimensions and specifications for the flexible bag are given. These provide for a representative bank incorporating the features of the present invention, however a variety of dimensions may be used. The dimensions and specifications given do result in a particularly advantageous embodiment of the instant invention, as will be understood.

The drawings constitute a part of this specification and include exemplary embodiments of the present invention, while illustrating various objects and features thereof. In some instances relative material thicknesses may be shown exaggerated to facilitate an understanding of the invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but rather merely as a basis for the claims and as a representative basis for teaching one skilled in the art to variously employ the present invention in virtually any appropriately detailed structure.

Figure 1:
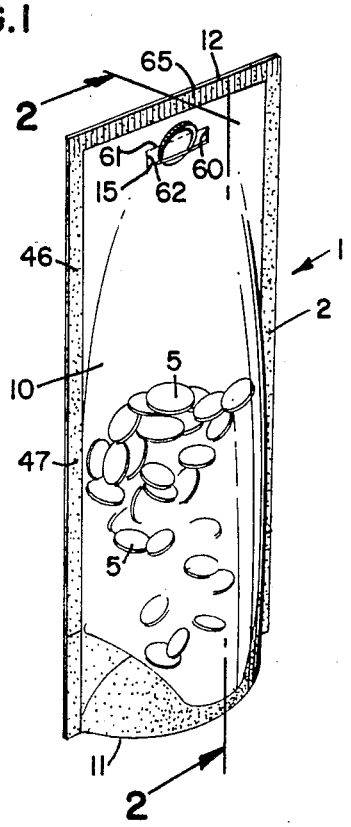
FIG. 1 is perspective view of a coin bank according to the present invention; the bank being shown expanded and standing upright, due to a plurality of coins being received therein.

The reference numeral 1, FIG. 1, generally designates the bank according to the present invention. The bank 1 comprises a flexible bag 2 appropriately adapted for receipt and storage of coins therein.

In FIG. 1 the bank 1 is shown with a plurality of coins 5 stored therein. It will be understood that in FIG. 1 the coins 5 are shown visible, due to construction of bank 1 from generally transparent materials. It will be understood that in other applications of the instant invention the entire bag 2, or portions of the bag 2, may be constructed from non-transparent materials, leaving the coins 5 non-viewable. In FIG. 1 only sufficient coins 5 are depicted to give a general understanding of expansion or swelling of the bag 2 under typical conditions of use.

Figure 2:
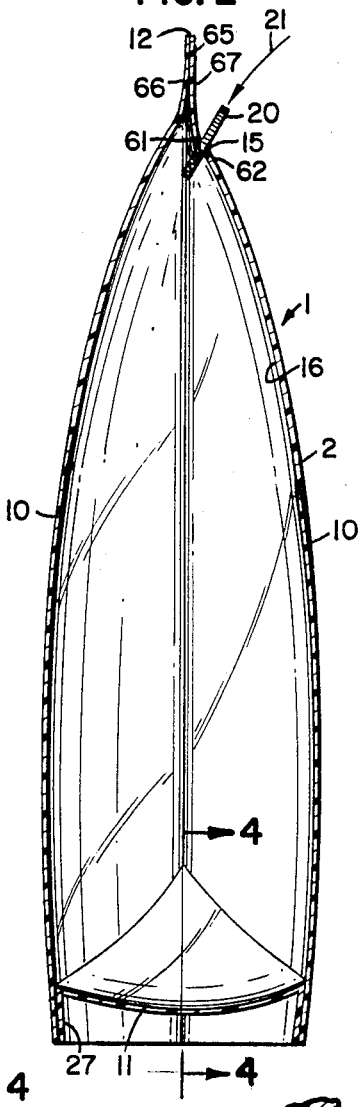
FIG. 2 is an enlarged side cross-sectional view taken generally along line 2—2 of FIG. 1.

Referring to FIGS. 1 and 2, the bank 1 comprises flexible bag 2 having a sidewall portion 10, a base or bottom portion 11, and an upper edge 12. The term "upper" and variants thereof, as used herein, refer to positioning of features of the bag 2, when same is stood in an upright position during normal operation and use. The terms "base", "bottom", "lower", and variants thereof, generally refer to bottom portions or portions relatively near the bottom of the bag 2, when same is stood upright as shown in FIG. 1 during normal operation and use. These directional terms are intended to provide ease of understanding of the description, and correlation with the drawings.

Referring again to FIGS. 1 and 2, during normal operation bag 2 stands upon the base portion 11, with the sidewall portion 10 extending upwardly. It is as the bag fills with coins that it will expand somewhat, to stand upon the base 11 with the coins, increasingly filling the bag 2 upwardly. Of course, when only a few coins are placed in the bag 2, the bank 1 will not stand upright. That is, a substantial number of coins 5 are needed before the base portion 11 is sufficiently expanded to support the sidewall portion 10 upright.

Figure 3:
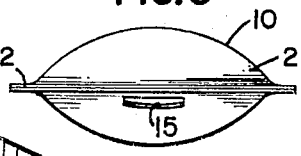
FIG. 3 is a reduced top plan view of the invention depicted in FIG. 1.

Referring to FIGS. 1, 2, and 3, the flexible bag 2 includes a coin slot 15 therein which provides communication between the exterior environment and an interior coin-receiving chamber 16 defined by the bag 2. In FIG. 2, coin 20 is shown being partially inserted through the coin slot 15 and into the coin-receiving chamber 16, generally through movement along the direction of arrow 21.

The upper edge 12 of the flexible bag 2 is sealed closed, in the preferred embodiment by means described below, to prevent coins from being poured outwardly of the bag when the bag is tipped over. Should the bag 2 tip over when full of coins 5 relatively few coins 5 will be lost, since the bag 2 contains substantially no open sides or edges; with the only ready communication within the interior of the bag 2 being through the relatively small coin slot 20.

Figure 5:
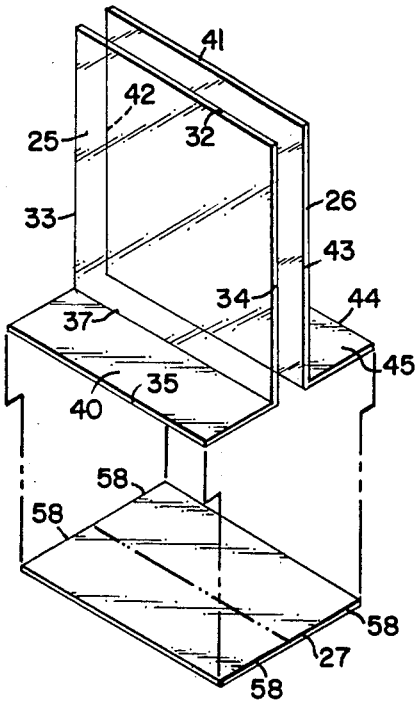
FIG. 5 is an exploded perspective view of a bank according to the present invention during assembly, with individual components forming the bank being depicted.
Figure 6:
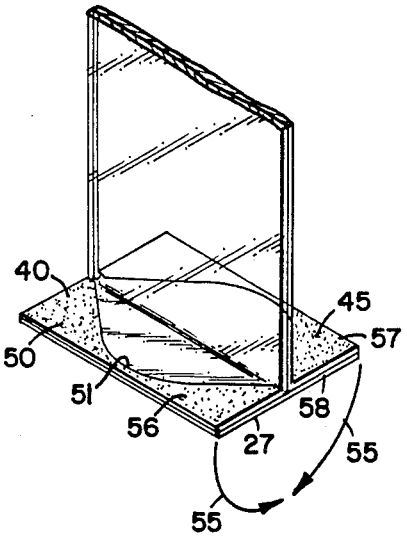
FIG. 6 is a perspective view showing the components of FIG. 5 partially assembled and with arrows generally indicating a step of folding to be accomplished in preparing a completed bank according to present invention.

Referring now to FIGS. 4–7:

The flexible bag 2 of the preferred embodiment is formed from first and second generally rectangular sidewall members 25 and 26, and a base member or portion 27, generally assembled as indicated by FIGS. 5 and 6. For the preferred embodiment of the present invention each of the sidewall members 25 and 26 respectively, and the base portion 27, is formed from a flexible plastic material capable of being heat-sealed. Thus, the bag 2 can be relatively easily and inexpensively manufactured and assembled, and is disposable following use. Further, the bag 2 may be easily cut open, as with scissors, a knife or the like, when desired.

Figure 7:
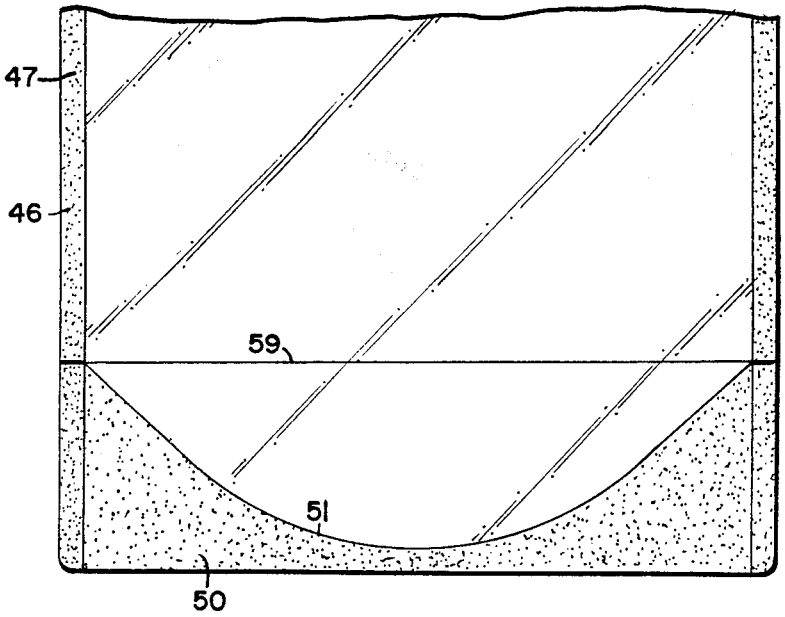
FIG. 7 is an enlarged, fragmentary, front elevational view of a bank according to the present invention manufactured generally according to the process depicted in FIGS. 5 and 6, and shown collapsed for storage.

Referring specifically to FIGS. 5, 6, and 7, rectangular sidewall member 25 has an upper edge 32, which is generally horizontal when the bag 2 is positioned upright as shown in FIG. 1; the upper edge 32 of sidewall member 25 forming a portion of the upper edge 12 of the bag 2.

Sidewall member 25 also includes substantially equal, opposite and parallel side edges 33 and 34, FIG. 5, and bottom edge 35. As is seen by examination of FIGS. 5 and 6, and will be understood from further descriptions below, each sidewall member, such as sidewall member 25, includes a fold, such as fold 37, placed therein during assembly of the flexible bag 2. As a result of the fold 37, a lower or bottom flap portion 40 of the sidewall member 25 is defined.

Generally, sidewall member 26 is substantially identical to, and is a mirror image of, sidewall member 25, FIG. 5, but for the presence of the coin slot 15 eventually placed in one of the sidewall members, 25 or 26. Thus, sidewall 26 includes upper edge 41, side edges 42 and 43, bottom edge 44 and lower flap 45.

Figure 4:
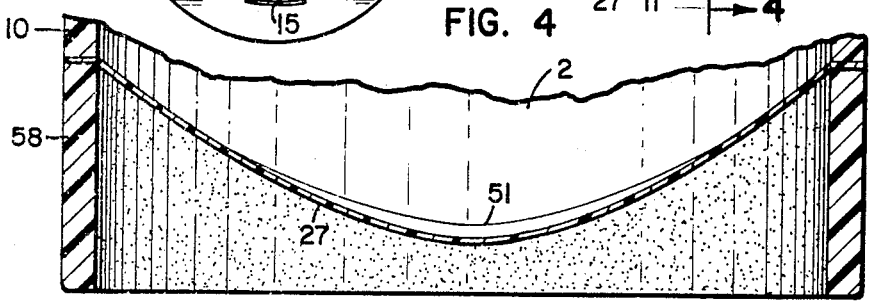
FIG. 4 is an enlarged fragmentary cross-sectional view taken generally along line 4—4 of Fig. 2.

Each sidewall member 25 or 26 includes an outer peripheral portion 46, FIGS. 1, 4 and 7, along which a seal such as heat-seal 47 may be formed to engage portions of the flexible bag 2, with one another, to enclose the same. In the drawings the heat-seal 47 is generally indicated by stippling. Referring to FIG. 5, generally a heat-seal is formed linking sidewall members 25 and 26 to one another along the upper edges, 32 and 41, and along those portions of the side edges, linking edges 33 to 42, and 34 to 43, which extend between the flap portions, 40 and 45, and the upper edges, 32 and 41 respectively.

The flap portions, 40 and 45 are sealed along an outer periphery thereof to the bottom or base portion 27, as shown in FIG. 6, preferably by means of a heat-seal or the like. In FIG. 6, the heat-seal is represented by seal 50 shown sealing so as to define a curved bottom outer edge 51 in the bag 2. Arrows 55, FIG. 6, shown how bottom flap portions 56 and 57 of the bag 2 should be folded, during assembly. After the folding, the base portion 23 is heat-sealed to itself along its side edges 58 to complete assembly.

The result of assembly according to FIGS. 5 and 6, with a relatively strong, flexible plastic ILLEGIBLE flat, envelope like bag, which may be easily stored in large numbers, due to having relatively little width. Referring to FIG. 7, the folded bag 2 will have a longitudinal fold 59 in the base portion 27, which will unfold during expansion from coins to provide base 11, FIG. 2.

Preferably the plastic material from which the bag 2 is constructed, while flexible, is sufficiently stiff to permit the bag 2 to stand upright, when only partially filled with coins.

Referring to FIGS. 1, 2 and 3, for the preferred embodiment the coin slot 15 comprises a rectangular opening or aperture 60 positioned in one of the two sidewall members 25 and 26. The rectangular aperture 60 is in part defined by an upper lip member 61 and a lower lip member 62 spaced apart from one another by the width of the aperture 60. Preferably slot or aperture 60 is sufficiently wide and long to permit relatively easy passage of appropriately sized coins therethrough. Also, preferably, the slot 60 is sized to permit passage of only one or a few coins at a time therethrough, so that should the bag 2 tip over when filled with coins only relatively few coins will be likely to fall out. Further, such an arrangement will generally discourage ready removal of saved coins from the bank, without substantial tampering with the bank's structure.

Both the upper lip member 61 and lower lip member 62 are somewhat flexible, and are therefore capable of being folded or laterally pushed away from one another, FIG. 2, to space apart permitting the coin 20 to enter the bag by substantially vertical, downward, movement. Preferably the flexible bag 2 includes retaining means suitable to maintain the flexible lip member 61 and 62 laterally spaced from one another, keeping the aperture 60 open for this general vertical passage of coins. This retaining means is a particularly advantageous feature of the instant arrangement, and will be understood from the following descriptions.

As indicated previously, the upper edge 12 of the flexible bag 2 is sealed closed. For the preferred embodiment sealing is accomplished by means of heat-seal 65 extending generally horizontally along the upper edge 12 of the bag; the term "horizontal" being used to refer to the extension of the heat-seal 65 when the bag 2 stands generally vertically upright. Upper heat-seal 65, in the preferred embodiment, is about ⅛ inch or 0.125 inches wide, and extends across the entire top edge 12 of the bag.

Referring to FIG. 2, as a result of the heat-seal 65, portions 66 and 67 of the sidewall members 25 and 26 respectively, which are substantially adjacent the heat-seal 65 are each retained in a substantially vertical orientation, even when the bag 2 is substantially swollen with coins. Generally, as a result of the flexible nature of the materials from which the sidewall members 25 and 26 are formed, this tendency to remain vertically extending increases, as the seal 65 is approached. That is, the bag 2 tapers inwardly and towards the vertical, as it extends upward. Thus, since the upper lip member 61 of the aperture 60 is positioned within the adjacent region 67, and closer to the seal 65, than the lower lip member 62, the upper lip member 61 while flexible, will tend to be maintained directed downwardly.

Of the other hand, the lower lip member 62 is somewhat more flexible, due to its lower position along the sidewall 26. Thus, under influence from swelling open of the bag, FIG. 2, the lower lip member 62 will tend to be pushed outwardly, that is be laterally spaced from the upper lip member 61. As a result, the rectangular opening or aperture 60 will tend to be spread open laterally, FIG. 2, and be retained open. On the other hand, should the bag 2 tip over, some pressure against the sidewall 26 may be relieved, allowing lip members 61 and 62 to collapse laterally toward one another, closing the bag 2 somewhat and inhibiting loss of coins therefrom.

Generally, for a typical taminated nylon/polyethylene bag, it will be preferred that the upper lip member 61 of the aperture 60 be positioned substantially adjacent, but spaced apart from, the upper seal 65. In the preferred arrangement the distance between the upper lip member 61 and the seal 65 is between about 0.25 and 0.75 inches, with the most preferred spacing being about 0.5 inches. Should the aperture 60 or coin slot 15 position be positioned substantially higher, or closer to the seal 65, it may be difficult to keep the slot 15 open to receive coins. Should the coin slot 15 be positioned substantially lower, or further away from the seal 65, it may also be difficult to keep the slot open. Further, a lower positioning of the slot facilitates loss of coins upon tipping over the bag 2, and prevents the bag 2 from being capable of being nearly completely filled.

A preferred flexible bag according to the present invention includes rectangular members about 10.25 inches long and about 5.75 inches wide. Of the about 10.25 inches in length, about 8.75 inches are taken up by the upper portions of the sidewalls, prior to the fold, with the resulting lower flap portions each being about 1.5 inches long and about 5.75 inches wide. The corresponding base portion, then, will be about 3.0 inches by about 5.75 inches.

A preferred coin slot is about 1.5 inches by about 3/16 or 0.1875 inches. Such a coin slot is sufficiently wide to accommodate coins up to the size of a United States half dollar, relatively easily. Further, such a coin slot is sufficiently small as to generally inhibit reaching into the bag to remove coins thereof, or substantial undesired coin loss upon tipping. Generally, the coin slot will be positioned in a substantially central location in one of the two sidewall members, in a position substantially adjacent to, but spaced apart from, the upper heat-seal 65, as described above.

The smaller dimension, or width, of the coin slot described above provides sufficient space in between the upper lip member 61 and lower lip member 62 to provide a desirably openable coin slot 15. It will be understood, however, that this spacing may vary, and generally a width of between at least about 0.125 and about 0.250 inches and can readily accommodate sufficient flexing between the upper and lower lip members, 61 and 62 respectively, for operability. In fact, in some instances spacings outside of this range may be desirable.

Again, a flexible bag bank according to the previous description is particularly desirable for use as described. The bag is substantially completely sealed along outer edges thereof, inhibiting unintended loss of coins upon tipping over. Further, undesired removal of the coins from the bag by persons other than the saver is generally inhibited, due to the fact that unless the bag were substantially damaged the coins could only relatively slowly be removed through the slot. That is, to rapidly remove large numbers of coins the bag would have to be cut or broken open, leaving signs of tampering.

On the other hand, the bag can be relatively quickly and inexpensively manufactured, as indicated by the assembly steps described. Further, bags may be constructed from a relatively inexpensive material such as a taminated nylon/polyethylene plastic. Prior to use, the bags can be conveniently stored since they are flat. Once filled with coins, they may be taken to a bank or other savings institution and be "broken open", as for example with a knife or scissors, for removal of the coins. The waste bag material, being inexpensive, then may be discarded. Further, since the bags are relatively inexpensive, they may be given out as complimentary items by banks, savings and loans and other institutions. It is foreseen that such bags may be relatively inexpensively marked or labeled with advertising indicia or the like, thus serving as advertising or promotional materials.

The construction described is also particularly advantageous for functioning as an upright bank, since a convenient base portion is presented enabling the bag to stand upright, once expanded with a substantial numbers of coins. Further, the expanding or swelling open of the bag will tend to retain the coin slot open for easy access, due to the retaining means described above. Finally, the bag may be constructed from a transparent or opaque material, permitting savers of coins to readily assess their progress.

It is to be understood that while certain embodiments of the present invention have been illustrated as described, the invention is not to be limited to the specific forms or arrangement of parts described and shown, except as according to the following claims.

What is claimed and desired to be secured by letters patent is as follows:

1. A coin bank comprising:

(a) flexible bag means having an upper edge, a side wal portion and a base portion;

(i) said side wall portion and said base portion defining an expandable internal coin-receiving chamber in said bag means;

(ii) said upper edge of said flexible bag means being sealed closed by an upper edge seal to substantially completely enclose said coin-receiving chamber; and, (iii) said side wall portion of said flexible bag means having a coin slot therein, said coin slot being sized and oriented to enable a coin to be selectively transferred into said coin-receiving chamber;

(iv) said coin slot having a flexible upper lip member and a flexible lower lip member; said upper lip member extending generally parallel to said upper edge of said flexible bag means; said lower lip member extending generally parallel to said upper lip member and being spaced apart therefrom by a distance of at least about 0.125 inches; and (b) retaining means for selectively keeping said slot in a relatively open, coin-receiving, orientation with said lower lip member spaced laterally spaced from said upper lip member, as said flexible bag is partially filled and swelled with coins;

(i) said retaining means including orienting said upper lip member spaced apart from said upper edge seal by a distance of about 0.25 inches and about 0.75 inches.

(ii) said retaining means selectively providing for said flexible upper and lower lip members to collapse toward one another, reducing lateral separation of same, when said bag is tipped over.

2. A coin bank according to claim 1 wherein:

(a) said upper edge seal comprises a heat-seal between about 0.0625 and 0.1875 inches in width.

3. A coin bank comprising:

(a) a flexible bag having an internal coin-receiving chamber formed from first and second substantially rectangular side wall members and a substantially rectangular base member;

(i) each of said rectangular side wall members and said rectangular base member being formed from a flexible plastic material capable of being heat-sealed;

(ii) each of said rectangular side wall members having: first and second opposite and generally parallel side edges; an upper edge extending generally perpendicular to, and communicating between, said side edges; and, a lower end portion;

(iii) said first and second side wall members being attached to one another along said first and second opposite side edges;

(iv) said first and second side wall members being heat-sealed to one another substantially along said upper edges to form an upper heat-seal;

(v) said base member being mounted on said first and second side wall members along said side-wall member lower end portions to substantially enclose said internal coin-receiving chambers;

(b) a coin slot oriented in one of said first and second side wall members to enable a coin to be transferred to within said coin-receiving chamber;

(i) said coin slot being substantially adjacent to, and spaced apart from, said upper heat seal and comprising a substantially rectangularly shaped aperture having a flexible upper lip member and a flexible lower lip member; said upper and lower lip members being spaced from one another to permit passage of a coin therebetween; and, (c) retaining means for retaining said coin slot in a substantially open orientation when said flexible bag is stood upright and is partially filled with, and swelled by, coins;

(i) said retaining means including generally flexible portions of said upper and lower lip members constructed and arranged for lateral movement with respect to one another.

(ii) said retaining means selectively permitting said flexible lip members to collapse toward one another should said bag be tipped over.

4. A coin bank according to claim 3 wherein:

(a) said coin slot upper lip member extends generally parallel to said upper heat seal and is spaced apart therefrom by a distance of between about 0.25 inches and about 0.75 inches; and, (b) said coin slot lower lip member extends generally parallel to said upper lip member and is spaced apart therefrom by a distance of at least about 0.125 inches.

5. A coin bank according to claim 4 wherein:

(a) said coin slot upper lip member is spaced from said upper heat seal by about 0.50 inches; and, (b) said coin slot lower lip member is spaced from said coin slot upper lip member by a distance of about 0.1875 inches.

* * * * *

UNITED STATES PATENT AND TRADEMARK OFFICE

CERTIFICATE OF CORRECTION

PATENT NO. : 4,718,738

DATED : January 12, 1988

INVENTOR(S) : GARY M. BELL

It is certified that error appears in the above-identified patent and that said Letters Patent is hereby corrected as shown below:

In the Abstract, line 4, before "polyethylene" insert --laminated nylon/--.

Col. 1, lines 8 and 66, delete "disposible" and insert --disposable--.

Col. 2, line 58, delete "disposible" and insert --disposable--.

Col. 6, line 3, delete "shown" and insert --show--.

Col. 6, line 9, after "plastic" insert --material such as a laminated nylon/polyethylene polymer is a substantially--

Col. 7, line 17, delete "taminated" and insert --laminated--.

Col. 8, line 11, delete "taminated" and insert --laminated--.

Col. 8, line 43, delete "wal" and insert --wall--.

Col. 8, line 66, delete "spaced". (second occurrence)

Col. 9, line 24, delete "perpendicular" and insert --perpendicularly--.

Claim 1, Col. 9, line 3, following "distance of" insert --between--.

Signed and Sealed this

First Day of November, 1988

*Attest:*

*Attesting Officer*

DONALD J. QUIGG

*Commissioner of Patents and Trademarks*